US009645532B2

(12) United States Patent
Kawaguchi

(10) Patent No.: US 9,645,532 B2
(45) Date of Patent: May 9, 2017

(54) FIXING DEVICE AND IMAGE FORMING APPARATUS

(71) Applicant: KYOCERA Document Solutions Inc., Osaka (JP)

(72) Inventor: Hirofumi Kawaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/165,314

(22) Filed: May 26, 2016

(65) Prior Publication Data

US 2016/0370742 A1 Dec. 22, 2016

(30) Foreign Application Priority Data

Jun. 18, 2015 (JP) ..... 2015-122829

(51) Int. Cl.
*G03G 15/20* (2006.01)

(52) U.S. Cl.
CPC ..... *G03G 15/2021* (2013.01); *G03G 15/2007* (2013.01); *G03G 15/2053* (2013.01); *G03G 15/2092* (2013.01); *G03G 2215/2006* (2013.01)

(58) Field of Classification Search
CPC ..... G03G 15/2021; G03G 15/2064; G03G 2215/2006; G03G 15/2007
USPC ..... 399/328, 330, 335, 341
See application file for complete search history.

(56) References Cited

U.S. PATENT DOCUMENTS 4,977,431 A * 12/1990 Fuji ..... G03G 15/2039 219/216
5,708,920 A * 1/1998 Ohnishi ..... G03G 15/2039 399/69
6,304,741 B1 * 10/2001 Tange ..... G03G 15/2053 219/216
2002/0102118 A1 * 8/2002 Kosugi ..... G03G 15/20 399/341
2004/0086306 A1 * 5/2004 Edahiro ..... G03G 15/2064 399/328
2007/0196120 A1 * 8/2007 Maeda ..... G03G 15/2039 399/69
2009/0245896 A1 * 10/2009 Ishikake ..... G03G 15/2007 399/328
2012/0114343 A1 * 5/2012 Kobayashi ..... G03G 15/2064 399/43

FOREIGN PATENT DOCUMENTS

JP 06202506 A * 7/1994
JP 09265243 A * 10/1997
JP 11212383 A * 8/1999
JP 2002-365967 12/2002
JP 2008-020483 1/2008
JP 2010072166 A * 4/2010

* cited by examiner

*Primary Examiner* — Robert Beatty

(74) *Attorney, Agent, or Firm* — Studebaker & Brackett PC

(57) ABSTRACT

A fixing device fixes a toner image formed on a recording medium to the recording medium. The fixing device includes a fixing roller, a pressure roller, and a first heater. The pressure roller is disposed opposite to the fixing roller to form a fixing nip therebetween. The first heater performs non-contact heating on the toner image that has passed through the fixing nip and that has been fixed to the recording medium to melt the toner image. The first heater is disposed adjacent to a conveyance path through which the recording medium that has passed through the fixing nip is conveyed.

9 Claims, 4 Drawing Sheets

| | Surface temperature of guide (℃) | Surface roughness Ra(μm) | Glossiness |
|---|---|---|---|
| Example 1 | 180 | 0.21 | 2.0 |
| Example 2 | 170 | 0.22 | 2.0 |
| Example 3 | 150 | 0.23 | 18 |
| Example 4 | 140 | 0.21 | 20 |
| Example 5 | 120 | 0.34 | 14 |
| Example 6 | 100 | 0.39 | 12 |
| Comparative Example | 75 | 0.46 | 10 |

FIG. 3

FIXING DEVICE AND IMAGE FORMING APPARATUS

INCORPORATION BY REFERENCE

The present application claims priority under 35 U.S.C. §119 to Japanese Patent Application No. 2015-122829, filed on Jun. 18, 2015. The contents of this application are incorporated herein by reference in their entirety.

BACKGROUND

The present disclosure relates to fixing devices and image forming apparatuses.

An image forming apparatus forms a toner image on paper. The image forming apparatus then applies heat and pressure to the paper to fix the toner image to the paper. As a result, an image is formed on the paper. Such an image forming apparatus is desired to form images (for example, a photographic image) having improved glossiness to keep up with improvement in image quality.

A first image forming apparatus and a second image forming apparatus are known as technology to improve glossiness of images.

The first image forming apparatus includes a fixing section and a cooling roller. The fixing section includes a heating roller and a pressure roller. In the fixing section, paper on which a toner image has been formed passes through a fixing nip between the heating roller and the pressure roller. As a result, the toner image is fixed to the paper. The cooling roller squashes and smoothes out irregularities in a surface of the fixed toner image while cooling the same. As a result, the image is improved in glossiness.

The second image forming apparatus includes a first fixing section and a second fixing section. The first fixing section includes a first heating roller and a first pressure roller. The second fixing section includes a second heating roller and a second pressure roller. In the first fixing section, paper on which a toner image has been formed passes through a first fixing nip between the first heating roller and the first pressure roller. As a result, the toner image is fixed to the paper. In the second fixing section, the paper to which the toner image has been fixed passes through a second fixing nip between the second heating roller and the second pressure roller. As a result, the temperature of the toner image is adjusted to an optimum temperature. Thus, the toner image is re-fixed to the paper. As a result, the image is improved in glossiness.

SUMMARY

A fixing device according to a first aspect of the present disclosure fixes a toner image formed on a recording medium to the recording medium. The fixing device includes a fixing roller, a pressure roller, and a first heater. The pressure roller is disposed opposite to the fixing roller to form a fixing nip therebetween. The first heater performs non-contact heating on the toner image that has passed through the fixing nip and that has been fixed to the recording medium to melt the toner image. The first heater is disposed adjacent to a conveyance path through which the recording medium that has passed through the fixing nip is conveyed.

An image forming apparatus according to a second aspect of the present disclosure includes an image forming section and the above-described fixing device. The image forming section forms a toner image on a recording medium.

BRIEF DESCRIPTION OF THE DRAWINGS

FIG. 3 shows results of measurement of surface roughness and glossiness of toner images fixed by the fixing section according to the embodiment of the present disclosure.

DETAILED DESCRIPTION

Figure 1:
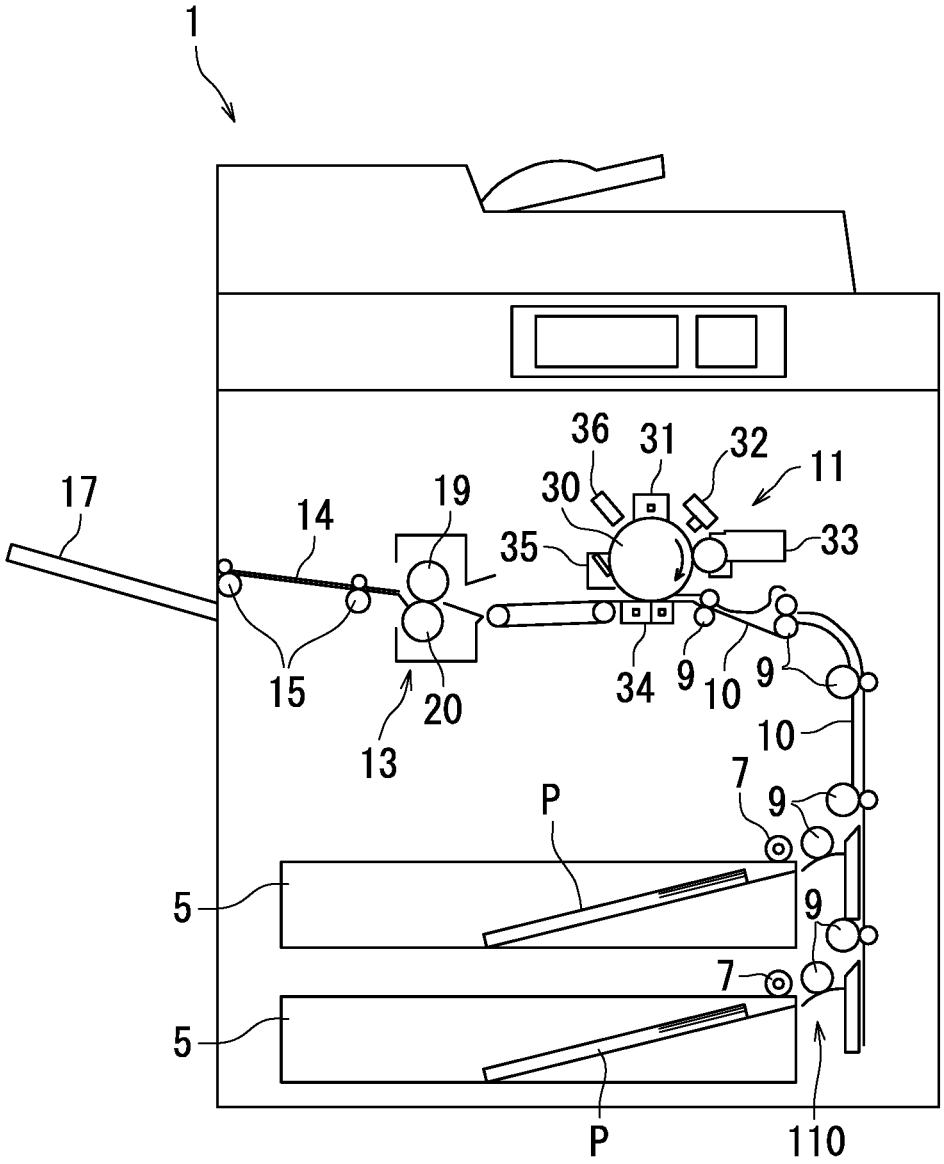
FIG. 1 illustrates configuration of an image forming apparatus according to an embodiment of the present disclosure.

The following describes an embodiment of the present disclosure with reference to the accompanying drawings. Note that in the drawings, elements that are the same or substantially equivalent are labelled using the same reference signs and description thereof is not repeated.

An image forming apparatus according to an embodiment of the present disclosure will be described with reference to FIG. 1. FIG. 1 illustrates configuration of the image forming apparatus according to the embodiment of the present disclosure.

An image forming apparatus 1 according to the embodiment of the present disclosure forms an image on paper P (recording medium) using toner. The image forming apparatus 1 includes paper feed cassettes 5, paper feed rollers 7, conveyance rollers 9, a conveyance path 10, an image forming section 11, a fixing section 13 (fixing device), a conveyance path 14, paper ejection rollers 15, and an exit tray 17.

Paper P is fed from each paper feed cassette 5 to the image forming section 11. A stack of a plurality of sheets of paper P is loaded in each paper feed cassette 5. Each paper feed roller 7 picks up the sheets of paper P in the corresponding one of the paper feed cassettes 5 one sheet at a time. The conveyance rollers 9 convey the paper picked up by the paper feed roller 7 to the image forming section 11 along the conveyance path 10.

The image forming section 11 forms an image on the paper P fed from the sheet feed cassette 5. The image forming section 11 includes a photosensitive drum 30, a charger 31, a light exposure device 32, a developing device 33, a transfer device 34, a cleaning device 35, and a static eliminator 36.

The photosensitive drum 30 has a photosensitive layer as a surface thereof. The charger 31 charges the surface of the photosensitive drum 30 to a specific electric potential. The light exposure device 32 irradiates the charged surface of the photosensitive drum 30 with laser light. As a result, the light exposure device 32 forms an electrostatic latent image based on image data on the surface of the photosensitive drum 30. The developing device 33 develops the electrostatic latent image on the surface of the photosensitive drum 30 into a toner image using a toner (for example, a black toner).

The transfer device 34 transfers the toner image from the surface of the photosensitive drum 30 to the paper P. The transfer device and the photosensitive drum 30 form a transfer nip therebetween. Transfer voltage is applied to the transfer device 34. Consequently, the toner mage is transferred to the paper P by electrostatic attractive force of the transfer device 34 as the toner image on the surface of the photosensitive drum 30 and the paper P simultaneously pass through the transfer nip. The paper P to which the toner image has been transferred is conveyed to the fixing section 13. The cleaning device 35 removes residual toner remaining on the surface of the photosensitive drum 30 after the transfer. The static eliminator 36 eliminates electric charge from the charged surface of the photosensitive drum 30 after the transfer.

After the toner image is transferred to the paper P, the fixing section 13 fixes the toner image to the paper P. The fixing section 13 applies heat and pressure to the paper P. As a result, the toner image is fixed to the paper P. The paper ejection rollers 15 eject the paper P to which the toner image has been fixed to the exit tray 17 along the conveyance path 14.

Figure 2:
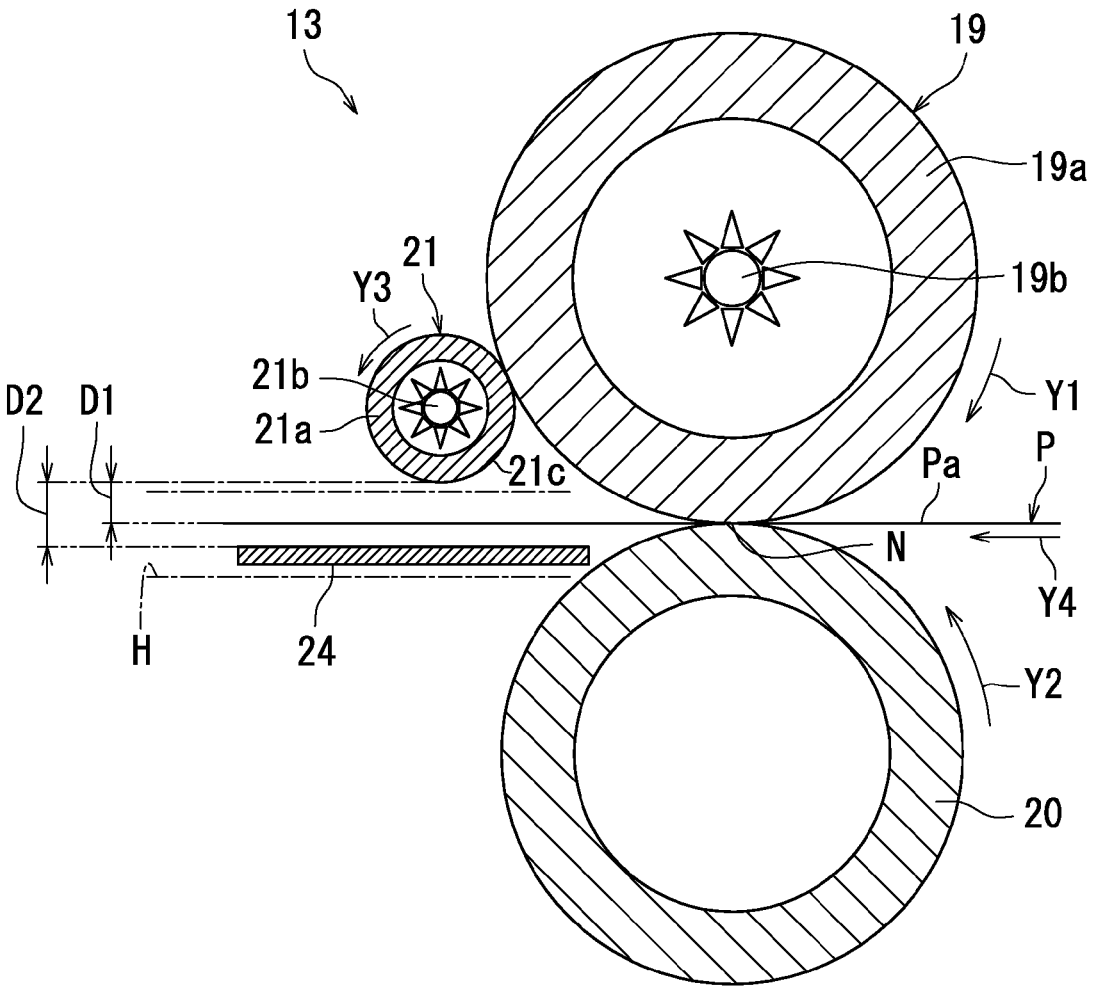
FIG. 2 illustrates configuration of a fixing section according to the embodiment of the present disclosure.

The following describes configuration of the fixing section 13 with reference to FIG. 2. FIG. 2 illustrates configuration of the fixing section 13 according to the embodiment of the present disclosure.

The fixing section 13 applies heat and pressure to paper P. As a result, a toner image is fixed to the paper P. The fixing section 13 applies heat to the paper P even after the toner image has been fixed. Thus, a surface of the toner image is smoothed. As a result, the surface of the toner image is improved in glossiness. Such smoothing reduces irregularities in the surface of the toner image.

The fixing section 13 includes a fixing roller 19, a pressure roller 20, a heating roller 21 (first heater), and a guide 24.

The fixing roller 19 applies heat to the paper P. The fixing roller 19 is rotatable. The fixing roller 19 and the pressure roller 20 form a fixing nip N therebetween. The fixing roller 19 includes a roller main body 19*a* and a heat source 19*b* (second heater). The roller main body 19*a* has a circular tubular shape. The roller main body 19*a* is rotatable about a central axis thereof. The heat source 19*b* is disposed inside of the roller main body 19*a*. The heat source 19*b* applies heat to the roller main body 19*a*. The fixing roller 19 heats the paper P while the paper P is passing through the fixing nip N using heat received from the heat source 19*b*. The paper P passes through the fixing nip N in a direction indicated by arrow Y4 with a side Pa thereof facing toward the fixing roller 19. The side Pa is a side to which the toner image has been transferred.

The pressure roller 20 applies pressure to the paper P. The pressure roller 20 has a circular tubular shape. The pressure roller 20 is rotatable about a central axis thereof. The pressure roller 20 and the fixing roller 19 form the fixing nip N therebetween. The pressure roller 20 applies pressure to the paper P while the paper P is passing through the fixing nip N. The pressure roller 20 is for example disposed under the fixing roller 19. The fixing nip N is therefore parallel to a horizontal direction. Accordingly, the paper P that has passed through the fixing nip N is conveyed out of the fixing nip N in the horizontal direction.

The fixing section 13 fixes the toner image to the paper P through application of heat by the fixing roller 19 and application of pressure by the pressure roller 20. The surface of the toner image fixed as described above includes irregularities transferred from an outer circumferential surface of the fixing roller 19.

The heating roller 21 melts the irregularities in the surface of the toner image transferred during fixing of the toner image. Consequently, the irregularities are smoothed out. As a result, the surface of the toner image is improved in glossiness. More specifically, the heating roller 21 performs non-contact heating on the toner image fixed to the paper P that has passed through the fixing nip N. The heating roller 21 melts irregularities in the surface of the toner image. As a result, the irregularities in the surface of the toner image are smoothed out. The toner image fixed to the paper P is heated by the heating roller 21 immediately after the paper P has passed through the fixing nip N. Heating of the toner image may include heating to the extent that solidification rate of the toner image is reduced. The solidification rate refers to a rate at which the surface of the toner image melted through heating by the fixing roller 19 solidifies. Even merely reducing the solidification rate improves surface roughness of the toner image.

The heating roller 21 includes a roller main body 21*a* and a heat source 21*b*. The roller main body 21*a* has a circular tubular shape. The roller main body 21*a* is rotatable about a central axis thereof. The heat source 21*b* is disposed inside of the roller main body 21*a*. The heat source 21*b* applies heat to the roller main body 21*a*. The heating roller 21 performs non-contact heating on the toner image fixed to the paper P using heat received from the heat source 21*b*. Since the toner image is heated without coming in contact with the heating roller 21, the surface of the toner image is prevented from having irregularities transferred from an outer circumferential surface of the heating roller 21.

The heating roller 21 is located adjacent to a conveyance path H. The heating roller 21 is in contact with the fixing roller 19. The conveyance path H is a space between the fixing nip N and the conveyance path 14 (see FIG. 1). The paper P that has passed through the fixing nip N is conveyed through the conveyance path H. Since the heating roller 21 is located adjacent to the conveyance path H, the heating roller 21 can perform non-contact heating on the toner image fixed to the paper P without applying heat at a relatively high temperature. Furthermore, since the heating roller 21 is in contact with the fixing roller 19, the heating roller 21 can be located adjacent to the fixing nip N. The toner image fixed to the paper P can therefore be heated by the heating roller 21 continuously after heating by the fixing roller 19. That is, the heating roller 21 can melt the surface of the toner image fixed to the paper P before the surface has cooled. The surface of the toner image immediately after heating (that is, before the surface has cooled) has a high wax concentration. Accordingly, the surface of the toner image is easier to melt immediately after heating than after the surface has cooled.

The heating roller 21 passively rotates with rotation of the fixing roller 19. It is therefore possible to prevent the heating roller 21 from damaging the surface of the fixing roller 19 during rotation of the fixing roller 19 even though the heating roller 21 is in contact with the fixing roller 19.

A temperature of a heating surface 21*c* of the heating roller 21 is for example higher than a temperature of the fixing nip N. The heating surface 21*c* is an outer circumferential surface of the roller main body 21*a*. In the fixing nip N, the toner image is melted through application of heat and pressure. In contrast, the heating roller 21 melts the toner image only through application of heat. A toner image is generally more difficult to melt when only heat is applied thereto than when heat and pressure are applied thereto. It is therefore preferable that the temperature of the heating surface 21*c* is higher than the temperature of the fixing nip N.

The guide 24 guides the paper P such that a gap D1 between the paper P and the heating roller 21 is no greater than a specific distance. The guide 24 restricts the paper P from separating from the heating roller 21 due to its own weight. The guide 24 guides the paper P that has passed through the fixing nip N. The gap D1 is for example at least 2 mm and no greater than 20 mm (preferably at least 2 mm and no greater than 10 mm).

As a result of the gap D1 being at least 2 mm, the paper P is less likely to come in contact with the heating roller 21. As a result of the gap D1 being no greater than 10 mm, the temperature of the heating surface 21*c* of the heating roller 21 does not need to be at a relatively high temperature in order for the heating roller 21 to melt the toner image on the paper P. As a result of the gap D1 being no greater than 20 mm, the fixing nip N is less likely to cause hot offset due to heat transmitted from the heating roller 21 to the fixing roller 19.

The guide 24 for example has a flat plate shape. The guide 24 is disposed at an opposite side of the paper P that has passed through the fixing nip N to a side of the paper P at which the heating roller 21 is disposed. The guide 24 is disposed along the conveyance path H. A gap D2 between the guide 24 and the heating roller 21 is for example at least 2 mm and no greater than 20 mm (preferably at least 2 mm and no greater than 10 mm). Consequently, the gap D1 between the paper P and the heating roller 21 is restricted to a range of at least 2 mm and no greater than 20 mm (preferably at least 2 mm and no greater than 10 mm).

In the fixing section 13, the fixing roller 19 is for example driven by a drive section, not shown, to rotate in a direction indicated by arrow Y1. With the rotation of the fixing roller 19, the pressure roller 20 passively rotates in a direction indicated by arrow Y2. Furthermore, the heating roller 21 passively rotates in a direction indicated by arrow Y3.

According to the present embodiment, as described above, smoothing of the toner mage includes (A) smoothing by melting of the toner image and (B) smoothing by reducing solidification rate of the toner image. In the case of (A), relationship of a temperature $T_{21c}$ of the heating surface 21*c* and a temperature $T_N$ of the fixing nip N is to satisfy $T_{21c}>T_N$. In the case of (B), the relationship is to satisfy $T_{21c} \leq T_N$.

The temperature of the heating roller 21 is lower in the case of (B) than in the case of (A). The gap D2 between the guide 24 and the heating roller 21 may therefore be narrower in the case of (B) than in the case of (A). That is, in a situation in which the temperature of the heating roller 21 is lower, the paper P can be closer to the heating roller 21 during conveyance.

The following describes operation of the fixing section 13 with reference to FIG. 2.

Once the paper P has conveyed from the image forming section 11 into the fixing section 13, the paper P passes through the fixing nip N with rotation of the fixing roller 19. While the paper P is passing through the fixing nip N, the fixing roller 19 applies heat to the paper P. The pressure roller 20 applies pressure to the paper P. As a result of application of heat and pressure, the toner image on the paper P is melted and fixed to the paper P.

The paper P that has passed through the fixing nip N then passes through the gap D2 between the heating roller 21 and the guide 24. While the paper P is passing through the gap D2, the guide 24 maintains the gap D1 between the paper P and the heating roller 21 within the specific distance. Thus, the gap D1 between the heating roller 21 and the paper P is prevented from being too large.

The heating roller 21 performs non-contact heating on the toner image fixed to the paper P passing through the gap D2 between the heating roller 21 and the guide 24. Such non-contact heating melts the surface of the toner image on the paper P without transferring irregularities in the surface of the heating roller 21 to the surface of the toner image. Thus, the surface of the toner image on the paper P is smoothed. As a result, the surface of the toner image is improved in glossiness.

The heating roller 21 is in contact with the fixing roller 19 during above-described non-contact heating. The surface of the toner image can therefore be heated continuously after heating at the fixing nip N. Thus, the heating roller 21 can start heating the fixed toner image before the toner image has cooled. The toner image is therefore readily melted. The paper P that has passed through the gap D2 is then conveyed to the conveyance path 14.

The following describes results of measurement of surface roughness and glossiness of toner images fixed by the fixing section 13 with reference to FIG. 3. FIG. 3 shows results of measurement of surface roughness (Ra) and glossiness of toner images.

FIG. 3 shows results of measurement of Examples 1 to 6 and Comparative Example. In Examples 1 to 6, the temperature of the outer circumferential surface of the fixing roller 19 was set at 160° C. to 180° C. The temperature of the heating roller 21 was adjusted such that a surface temperature of the guide 24 varied within a range of from 100° C. to 180° C. The surface temperature of the guide 24 was a temperature influenced by heat from the fixing roller 19 and heat from the heating roller 21. More specifically, the surface temperature of the guide 24 was 180° C. in Example 1, 170° C. in Example 2, 150° C. in Example 3, 140° C. in Example 4, 120° C. in Example 5, and 100° C. in Example 6.

Comparative Example was under the same conditions as Examples 1 to 6 except that heating by the heating roller 21 was stopped in Comparative Example. The surface temperature of the guide 24 was 75° C. in Comparative Example. The surface temperature (75° C.) of the guide 24 in Comparative Example was a temperature influenced only by heat from the fixing roller 19. Accordingly, a temperature difference between the surface temperature of the guide 24 in each of Examples 1 to 6 and the surface temperature (75° C.) of the guide 24 in Comparative Example was a temperature influenced only by heat from the heating roller 21.

In Examples 1 to 6 and Comparative Example, a 3 cm square solid image in for example black was formed on paper P, and surface roughness and glossiness of the solid image were measured.

As shown in FIG. 3, the results of the surface roughness measurement and the glossiness measurement of Examples 1 to 6 were better than those of Comparative Example. With respect to Examples 1 to 6, the higher the surface temperature of the guide 24 was (that is, the higher the temperature of the heating roller 21 was), the more the surface roughness and the glossiness were improved.

Through the above, an embodiment of the present disclosure has been described with reference to the drawings (FIGS. 1 to 3). However, the present disclosure is not limited to the above embodiment and may be implemented in various different forms that do not deviate from the essence of the present disclosure (for example, as described below in sections (1)-(3)). The drawings schematically illustrate elements of configuration in order to facilitate understanding. Properties of elements of configuration illustrated in the drawings, such as thickness, length, and number thereof, may differ from actual properties thereof in order to facilitate preparation of the drawings. Furthermore, properties of elements of configuration described in the above embodiment, such as shapes and dimensions, are merely examples and are not intended as specific limitations. Various alterations may be made so long as there is no substantial deviation from the effect of the present disclosure.

Figure 4:
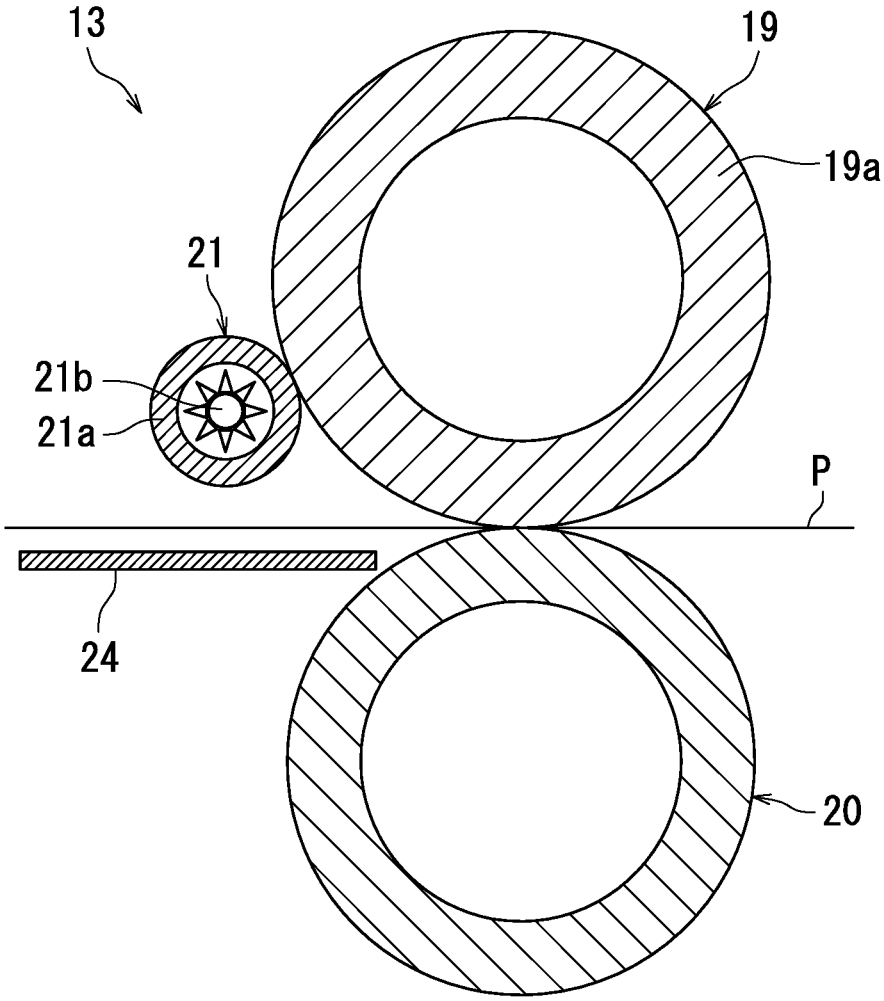
FIG. 4 illustrates configuration of a variation of the fixing section according to the embodiment of the present disclosure.

(1) FIG. 4 illustrates configuration of a variation of the fixing section 13 according to the above-described embodiment. As illustrated in FIG. 4, the heat source 19*b* of the fixing roller 19 may be omitted in the fixing section 13 of the embodiment. In such a configuration, the heating roller 21 also functions as a heat source for heating the fixing roller 19.

(2) The heating roller 21 is in contact with the fixing roller 19 in the above-described embodiment. Alternatively, the heating roller 21 may be spaced from the fixing roller 19. In such a configuration, the heating roller 21 is preferably spaced from the fixing roller 19 within a range that allows the heating roller 21 to start heating a toner image having been heated during fixing before the toner image has cooled.

(3) In the configuration described in section (2), the heating roller 21 does not need to be a roller. For example, a plate-shaped or square bar-shaped heater may be used instead of the heating roller 21.

What is claimed is:

1. A fixing device for fixing a toner image formed on a recording medium to the recording medium, comprising:

a fixing roller;

a pressure roller disposed opposite to the fixing roller to form a fixing nip therebetween; and a first heater configured to perform non-contact heating on the toner image that has passed through the fixing nip and that has been fixed to the recording medium to melt the toner image, wherein the first heater is disposed adjacent to a conveyance path through which the recording medium that has passed through the fixing nip is conveyed, and a gap between the first heater and the recording medium that has passed through the fixing nip is at least 2 mm and no greater than 20 mm.

2. The fixing device according to claim 1, wherein the first heater is in contact with the fixing roller.

3. The fixing device according to claim 1, further comprising a second heater configured to heat the fixing roller.

4. The fixing device according to claim 1, further comprising a guide disposed at an opposite side of the first heater with respect to a center line of the conveyance path.

5. The fixing device according to claim 1, wherein the first heater has a heating surface that heats the toner image, and a temperature of the heating surface is higher than a temperature of the fixing nip.

6. The fixing device according to claim 1 wherein the pressure roller is disposed under the fixing roller, the fixing nip is parallel to a horizontal direction, and the recording medium that has passed through the fixing nip is conveyed out of the fixing nip in the horizontal direction.

7. The fixing device according to claim 1, wherein the fixing roller melts the toner image formed on the recording medium, and the first heater performs non-contact heating on the toner image that has been melted by the fixing roller to melt the toner image, so that a solidification rate at which a surface of the toner image solidifies is reduced.

8. The fixing device according to claim 2, wherein the first heater passively rotates with rotation of the fixing roller.

9. An image forming apparatus comprising:

an image forming section configured to form a toner image on a recording medium; and the fixing device according to claim 1.

* * * * *